US006948271B2

(12) United States Patent
Helgeson et al.

(10) Patent No.: US 6,948,271 B2
(45) Date of Patent: Sep. 27, 2005

(54) IDENTIFICATION AND TRACKING SYSTEM FOR DECEASED BODIES

(75) Inventors: Peter James Helgeson, Roseau, MN (US); John Richard Jaskulaske, Maplewood, MN (US); Ty Bryan Sunderman, St. Paul, MN (US)

(73) Assignee: Innovative Supply, Inc., St. Paul, MN (US)

( * ) Notice: Subject to any disclaimer, the term of this patent is extended or adjusted under 35 U.S.C. 154(b) by 0 days.

(21) Appl. No.: 10/430,449

(22) Filed: May 6, 2003

(65) Prior Publication Data

US 2004/0068905 A1 Apr. 15, 2004

Related U.S. Application Data

(60) Provisional application No. 60/378,434, filed on May 6, 2002.

(51) Int. Cl.[7] ..... G09F 3/14

(52) U.S. Cl. ..... 40/633; 235/385

(58) Field of Search ..... 40/586, 632, 633, 40/639; 235/385; 283/74, 75

(56) References Cited

U.S. PATENT DOCUMENTS

| | | | | | |
|---|---|---|---|---|---|
| 1,246,753 | A | * | 11/1917 | Taylor | 40/632 |
| 2,954,620 | A | * | 10/1960 | Schneider | 40/633 |
| 4,031,640 | A | | 6/1977 | Hanna, Jr. et al. | 283/77 |
| 4,121,360 | A | * | 10/1978 | Vlerebome | 40/586 |
| 4,154,011 | A | * | 5/1979 | Rakestraw et al. | 40/633 |
| 5,448,846 | A | * | 9/1995 | Peterson et al. | 40/633 |
| 5,615,504 | A | * | 4/1997 | Peterson et al. | 40/633 |
| 5,758,443 | A | * | 6/1998 | Pedrazzini | 40/633 |
| 5,873,188 | A | * | 2/1999 | Gehris | 40/633 |
| 6,055,756 | A | * | 5/2000 | Aoki | 40/633 |
| 6,349,493 | B1 | * | 2/2002 | Newman et al. | 40/633 |
| 6,382,111 | B1 | | 5/2002 | Hojaji | 110/341 |
| 6,388,612 | B1 | * | 5/2002 | Neher | 342/357.07 |
| 6,761,312 | B2 | * | 7/2004 | Piatek et al. | 235/385 |

* cited by examiner

*Primary Examiner*—Lars A. Olson
(74) *Attorney, Agent, or Firm*—Merchant & Gould P.C.

(57) ABSTRACT

An identification system for deceased bodies is disclosed. The system includes an identification tag, such as a band, that is attached to the decedent's body and that cannot be removed without destroying the integrity of the identification tag or mutilating the body. Additionally, the identification tag remains intact throughout the burial preparation process, and further remains intact upon burial or other disposal of the body, such as by cremation. The identification tag also provides a system for tracking the body.

7 Claims, 1 Drawing Sheet

IDENTIFICATION AND TRACKING SYSTEM FOR DECEASED BODIES

Priority under 35 U.S.C. § 119(e) is claimed to provisional application Ser. No. 60/378,434, filed on May 6, 2002, and entitled "Identification and Tracking System for Deceased Bodies". The complete disclosure of application Ser. No. 60/378,434 is incorporated by reference herein.

BACKGROUND OF THE INVENTION

The present invention is directed to a system for identifying and tracking a deceased body. In particular, the system of the present disclosure is directed to tracking a body among various after-death loci, such as the funeral home, the crematorium, the retort, to final resting place, which may be as cremated remains.

It is not an unusual occurrence for deceased bodies to be mistakenly switched at morgues, at funeral homes, or at crematoriums. Such an occurrence is traumatic to the decedent's family and friends, and can be a large liability on the part of the funeral home, crematorium, or other involved party. Recent events have uncovered instances where deceased bodies were not processed as intended by the decedent's family, or as required by law, but rather, bodies have been disposed of in dumping grounds.

Attempts have been made to place an identification tag or other sort of identification means on the bodies in order to minimize, and preferably eliminate, the occurrence of mistaken identity. Such a system would improve the ease of mind of the decedent's family. However, these attempts at tagging have had disadvantages in that the identification tag can be removed from the body, can be mutilated, destroyed or tampered with, or the tags themselves can be destroyed by the burial process (such as during the cremation process).

What is desired is an identification system for deceased bodies that, once attached to the body, cannot be removed from the body and that will stay with the body throughout the burial process. In addition, it is desirable that such an identification system be associated with a reliable tracking system that allows users of the system to instantaneous identify and locate the body at an stage of the post-mortem proceedings.

SUMMARY OF THE INVENTION

The present disclosure is directed to an identification system for deceased bodies. The system includes an identification tag, such as a band, that is attached to the decedent's body and that cannot be removed without destroying the integrity of the identification tag or mutilating the body. Additionally, the identification tag remains intact throughout the burial preparation process, and further remains intact upon burial or other disposal of the body, such as by cremation. The identification tag also provides a system for tracking the body.

In one particular embodiment, the present disclosure is directed to a system that uses a metal band having a registration number permanently positioned thereon. Once attached to the decedent, such as around a wrist or ankle, the band cannot be removed from the body with destroying either the integrity of the band or the body. The metal band is capable of withstanding any conditions the body may be exposed to, such as caustic solutions, cold temperatures (such as during cryogenics), and high temperatures (such as during cremation), without destroying the integrity of the band or the registration number. The registration number from the band is assigned to a specific decedent, and that assignment is registerable in a database or other tracking system. The database retains information related to the decedent, his family, and other desired or pertinent information.

DETAILED DESCRIPTION OF THE PREFERRED EMBODIMENT

Figure 1:
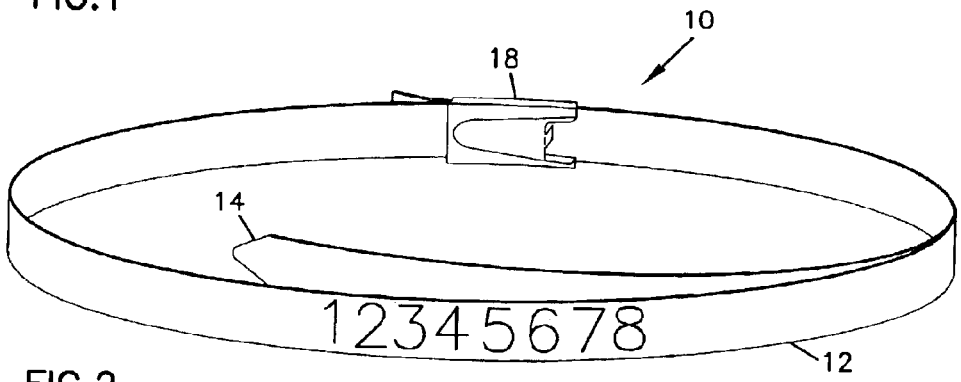
FIG. 1 is a perspective view of an identification band for use with the method of the present invention, the band shown in a closed configuration.
Figure 2:
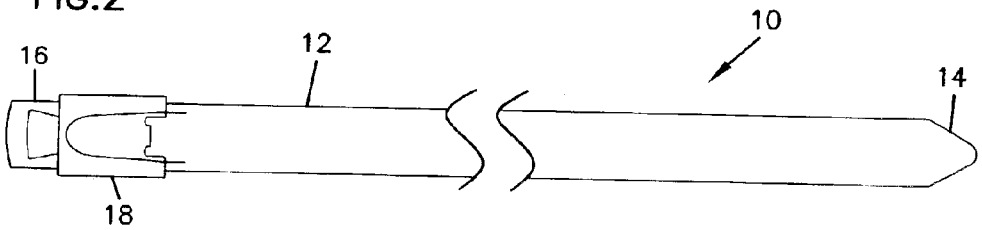
FIG. 2 is a perspective view of the identification band of FIG. 1, shown in an open configuration.
Figure 3:
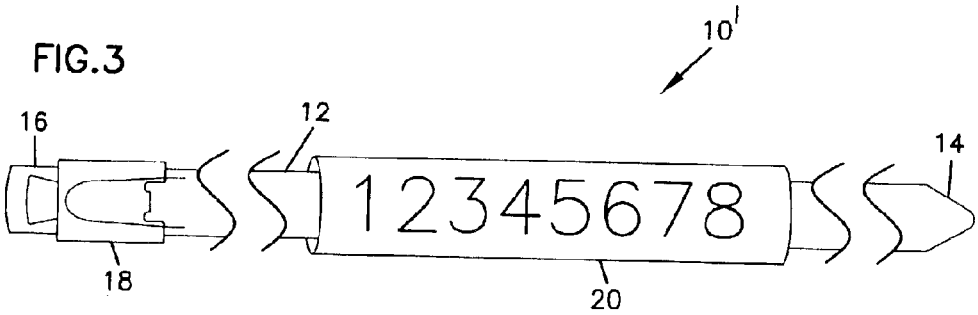
FIG. 3 is a perspective view of an alternate embodiment of an identification band of the present invention.

Turning now to the figures, one preferred embodiment of the present disclosure is illustrated. In FIGS. 1 and 2, an identification tag, in particular, an identification band 10, is shown. Band 10 has a body 12 having a first end 14 and a second end 16 at the end opposite first end 14. Located at second end 16 is a connecting system or mechanism, such as a clasp 18, configured for permanently engaging band 12 adjacent its first end 14. By the term "permanently", what is intended is that after first end 14 has been engaged with clasp 18 at second end 16 to form a closed band, first end 14 cannot be disengaged, detached, or otherwise removed from clasp 18. Although one configuration of clasp 18 has been shown, it is understood that any permanent clasp would be acceptable. FIG. 2 shows band 10 in an unengaged, open position, whereas FIG. 1 shows band in a closed position, permanently formed into a loop. An alternate embodiment, as band 10', is shown in FIG. 3; band 10' includes sleeve 20, which will be described in detail below.

Body 12 should have sufficient length between first end 14 and second end 16 so that band 10 can be attached around the desired body area, such as around an ankle or a wrist. It may be desired to have body 12 sufficiently sized so that band 10 can be attached around a body's neck, waist, or other area. Band 10 can be configured to be attachable around all of a wrist, ankle, neck, waist, for example, or band 10 may be specifically designed to be attachable around, for example, a neck. Generally, the location available for attachment of band 10 is determined by the length of body 12. Band 10 should preferably not be attached to an area of the body where band 10 may damage the decedent or where its presence would be visually unacceptable for funeral visitation purposes or the like. One suitable length for body 12 is about 14 inches; a length of 14 inches is sufficient to circumscribe an ankle or wrist for most bodies. An 8 inches length is also suitable to circumscribe an ankle or wrist for some bodies. Body 12 may be shorter, for example 4 to 6 inches, for very small bodies or for children.

The width of body 12 should be sufficiently wide to accept a registration number thereon, yet not so thick to hinder attachment of band 10 onto the body. One suitable width for body 12 is about ¼ inch; other suitable body widths are ⅜ inch and ½ inch. In some embodiments a width of ¾ inch or even 1 inch may be desired.

Figure 4:
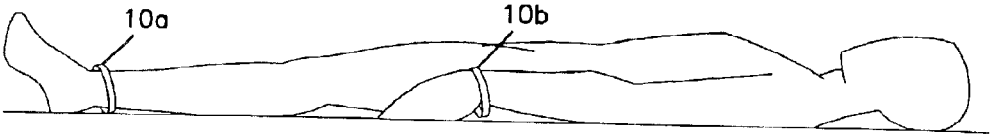
FIG. 4 is a schematic view of a body illustrating the identification band of FIG. 1 secured thereto at two exemplary locations.

See FIG. 4, where a first band 10*a* is shown attached at an ankle. A second band 10*b* is shown attached at a wrist. It is understood that each body will generally have only one band 10 attached thereto, and bands 10*a* and 10*b* are illustrated on the same body merely for multiple location illustration purposes.

Each of body 12, clasp 18, and sleeve 20 is made from a material suitable for withstanding any and all elements to which band 10 may be exposed. That is, the parts should not degrade under toxic conditions, acidic or basic conditions, under high temperatures, or low temperatures. In particular, body 12, clasp 18, and sleeve 20 should be able to withstand the high temperatures (usually as high as about 2500° F.) of a retort without substantial degradation or deformation. Additionally, body 12, clasp 18, and sleeve 20 should not degrade or decompose over time, if exposed to underground elements. Suitable materials for body 12, clasp 18, and sleeve 20 include metals having a melting point no less than about 2000° F., metals such as steel (mild steel, stainless steel, hard steel), wrought iron, chromium, nickel, palladium, platinum, titanium, tungsten, and various alloys thereof Some ceramic materials may also be suitable. Stainless steels are preferred materials, due to their high temperature resistance and their malleability. One example of a preferred stainless steel for body 12, clasp 18, and sleeve 20 is 310 SS. It is understood that the various portions of band 10, such as body 12, clasp 18, and sleeve 20, may be made from the same or different materials.

Band 10 further includes a registration number or other identifying indicia or marking thereon. This registration number or other identifying indicia could be provided directly on body 12 (as illustrated in FIG. 1) or on a sleeve 20 such as illustrated in FIG. 3 with band 10'. Sleeve 20 could be configured to slide along body 12 once on body 12, or sleeve 20 could form a tight fit or be crimped. Prior to attachment of band 10 onto the deceased body, sleeve 20 would be slid over end 14 and onto body 12. Sleeve 20 would not be removable from body 12 once band 10' is engaged (i.e., end 14 is permanently connected to clasp 18). Having the registration number or other identifying indicia on sleeve 20 allows the installer to select the most appropriate sized band 10 for the decedent.

Although Arabic numerals have been illustrated on band 10 in FIG. 1 and the discussion uses the terminology "number(s)", it should be understood that other designations such as alpha characters, geometric shapes, symbols, or combinations thereof, could additionally or alternatively be used. The registration number is permanently affixed, adhered, etched, embossed, or otherwise permanently present on body 12. The registration number should withstand any and all elements and conditions to which band 10 may be exposed without being rendered illegible.

Each band 10 should have a unique registration number. The registration number can be used to track the body throughout the course of the process, that is, from the point where band 10 is attached, to the final disposition of the decedent (such as burial or cremation). Further, it is understood that such registration number can be subdivided or grouped into various identifiable and/or searchable fields of information relating to the registration process.

Band 10 may include an area where the decedent's name, social security number, or other personal identifying information is provided; this area could be on body 12 or on sleeve 20. This information, such as the decedent's name, is a quick identifier and personalizes the decedent more than just a registration number does. In most scenarios, any personal identifying information would be provided on band 10 immediately prior to, or after, band 10 is attached to the body. This personal information could be permanently provided onto body 12, such as by etching, embossing, etc., or could be not-so-permanent, for example be provided by an ink marker.

Band 10 could be attached to the decedent at the hospital, hospice, or wherever the person dies, but in many instances, band 10 will be attached at the funeral home. When band 10 is attached to the decedent, the registration number is recorded in a retrievable location or data system. The funeral home, hospital, and or other facility may have its own banding and recordation system. However, in order to facilitate retrieval of the registration number as the body progresses through the various loci after death (for example, from the hospital to the funeral home to the crematorium), it is convenient to have a master database of the registration numbers administered by a local or state authority, agency or other entity. It is feasible that the authority, agency or other entity administering the database be a Federal authority or agency. By having a national, Federal administration, tracking of the body is not compromised at state borders, and the tracking system would be uniformly administered nationwide.

This tracking system may require confirmation of the registration number throughout the processing of the body. For example, as the body arrives at and leaves each loci, the registration number must be confirmed as being the correct number for that body, and the movement of the body can be tracked by the administrative entity.

As an example, a body, tagged at the hospital morgue, has the registration number recorded with the agency administering the tracking system. When the body leaves the morgue, paperwork is processed and the administering agency is informed of the body leaving the morgue. When the body arrives at the funeral home, the funeral director or other employee checks the identification number and confirms with the administering agency that the body received is the correct one. As the body leaves the funeral home, the agency is again informed, and the body is transferred to the crematorium. An employee at the crematorium confirms the registration number and informs the agency. Prior to being cremated, the registration number is again confirmed as being assigned to the body to be cremated. As the ashes are removed from the retort, band 10 can be checked as a confirmation of the proper identification as well as for physical integrity of band 10, indicating that it had not been opened or tampered with. Further, the physical condition of the band can provide assurance in cases of cremating, that band 10 has in fact been subjected to the high temperatures of a retort. It is understood that any of these confirmation steps, along with signatures of the responsible personnel, may or may not be required. That is, the tracking system can be designed to have any number of checkpoints of varying requirements.

It is understood that although the example provided above has described the decedent's body as being cremated, the identification system is also beneficial with other disposal methods of the body, such as conventional burying in a cemetery. Such identification system is also beneficial for identifying bodies having been illegally or improperly buried or disposed.

The above specification, examples and data provide a complete description of the manufacture and use of the invention. Since many embodiments of the invention can be made without departing from the spirit and scope of the invention, the invention resides in the claims hereinafter appended.

What is claimed:

1. A method of tracking a deceased body, the method comprising:

(a) providing a band having a permanent connecting system;

(b) permanently attaching the band to the deceased body, the body located at a first locus, and the band having registration indicia present thereon;

(c) recording the registration indicia with an administration entity;

(d) moving the body with the band attached thereto from the first locus to a crematory;

(e) cremating the body to form ash; and (f) identifying the ash from the body via the registration indicia.

2. The method according to claim 1, wherein the band comprises a material having a melting point of no less than about 2000° F.

3. The method according to claim 1, wherein the band comprises a material having a melting point of no less than about 2500° F.

4. The method according to claim 1, wherein the first locus is a morgue.

5. A method of tracking a deceased body, the method comprising:

(a) providing a band having a permanent connecting system;

(b) permanently attaching the band to the deceased body, the body located at a first locus in a crematory, and the band having registration indicia present thereon;

(c) recording the registration indicia;

(d) moving the body with the band attached thereto from the first locus to a second locus in the crematory;

(e) cremating the body to form ash; and (f) identifying the ash from the body via the registration indicia.

6. The method according to claim 5, wherein the band comprises a material having a melting point of no less than about 2000° F.

7. The method according to claim 5, wherein the band comprises a material having a melting point of no less than about 2500° F.

* * * * *

UNITED STATES PATENT AND TRADEMARK OFFICE

CERTIFICATE OF CORRECTION

PATENT NO. : 6,948,271 B2
DATED : September 27, 2005
INVENTOR(S) : Helgeson et al.

It is certified that error appears in the above-identified patent and that said Letters Patent is hereby corrected as shown below:

Title page,
Item [75], Inventors, "John Richard Jaskulaske" should be
-- John Richard Jaskulske --.

Signed and Sealed this

Twenty-first Day of March, 2006

JON W. DUDAS
*Director of the United States Patent and Trademark Office*